US009527685B2

(12) United States Patent
Kawamura et al.

(10) Patent No.: US 9,527,685 B2
(45) Date of Patent: Dec. 27, 2016

(54) FEEDING APPARATUS AND IMAGE FORMING APPARATUS

(71) Applicant: CANON KABUSHIKI KAISHA, Tokyo (JP)

(72) Inventors: Koji Kawamura, Susono (JP); Takehito Osada, Suntou-gun (JP); Shoichi Zensai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/657,995

(22) Filed: Mar. 13, 2015

(65) Prior Publication Data

US 2015/0259163 A1 Sep. 17, 2015

(30) Foreign Application Priority Data

Mar. 17, 2014 (JP) ..... 2014-054175

(51) Int. Cl.

*B65H 3/06* (2006.01)
*B65H 1/14* (2006.01)
*B65H 7/04* (2006.01)

(52) U.S. Cl.

CPC ..... *B65H 3/0684* (2013.01); *B65H 1/14* (2013.01); *B65H 7/04* (2013.01); *B65H 2403/41* (2013.01); *B65H 2403/53* (2013.01); *B65H 2403/73* (2013.01); *B65H 2511/515* (2013.01); *B65H 2513/40* (2013.01); *B65H 2601/324* (2013.01)

(58) Field of Classification Search

CPC ..... B65H 1/08; B65H 1/14; B65H 1/18; B65H 3/0684; B65H 2405/1117; B65H 2301/42324; B65H 2553/60; B65H 2553/61; B65H 2553/612; B65H 7/00;B65H 7/02; B65H 7/04; B65H 7/14; B65H 7/18; B65H 2511/152; B65H 2511/515; B65H 2511/21

USPC ..... 271/152, 153, 154, 155

See application file for complete search history.

(56) References Cited

U.S. PATENT DOCUMENTS

| | | | | |
|---|---|---|---|---|
| 5,123,637 | A * | 6/1992 | Musaka | G03G 15/6502 271/117 |
| 5,722,653 | A * | 3/1998 | Seidl | B65H 1/18 271/117 |
| 7,753,366 | B2 * | 7/2010 | Kawanishi | B65H 1/18 271/152 |
| 2008/0001342 | A1 * | 1/2008 | Matsushima | B65H 1/14 271/3.14 |
| 2010/0044951 | A1 * | 2/2010 | One | B65H 1/266 271/10.11 |

(Continued)

FOREIGN PATENT DOCUMENTS

| | | | |
|---|---|---|---|
| JP | 06056305 | A * | 3/1994 |
| JP | 2009-012925 | A | 1/2009 |

(Continued)

*Primary Examiner* — Ernesto Suarez

(74) *Attorney, Agent, or Firm* — Canon USA, Inc. IP Division

(57) ABSTRACT

A feeding apparatus and an image forming apparatus capable of appropriately detecting sheets stacked on a stacking plate are provided. The feeding apparatus includes a sheet contact portion configured to make contact with a sheet stacked on a stacker. The sheet contact portion is arranged between a position where a feed roller makes contact with the sheet and a position where a conveyance roller makes contact with the sheet, in a feeding direction, and within an area of the feed roller in an axial direction of the feed roller.

18 Claims, 12 Drawing Sheets

(56) References Cited

U.S. PATENT DOCUMENTS

| | | | | |
|---|---|---|---|---|
| 2013/0222505 | A1* | 8/2013 | Akatsuka | B41J 11/0095 347/110 |
| 2014/0239573 | A1* | 8/2014 | Akai | B65H 3/06 271/109 |
| 2015/0115521 | A1* | 4/2015 | Ishida | B65H 1/18 271/153 |
| 2015/0151935 | A1* | 6/2015 | Murakami | B65H 1/14 271/3.19 |

FOREIGN PATENT DOCUMENTS

| | | | |
|---|---|---|---|
| JP | 2009-202967 | A | 9/2009 |
| JP | 4612893 | B2 | 1/2011 |
| JP | 2011-057386 | A | 3/2011 |
| JP | 2014-105099 | A | 6/2014 |

* cited by examiner

FEEDING APPARATUS AND IMAGE FORMING APPARATUS

BACKGROUND OF THE INVENTION

Field of the Invention

The present invention relates to a feeding apparatus and an image forming apparatus.

Description of the Related Art

An image forming apparatus such as a printer and a copying machine conventionally includes a feeding apparatus for feeding sheets one by one. As a feeding apparatus, a configuration including a stacking plate serving as a sheet stacking unit and a feed roller for feeding sheets on the stacking plate is known.

The feeding apparatus includes a sheet surface detection mechanism for detecting the height of the topmost surface of the sheets on the stacking plate. Japanese Patent Application Laid-Open No. 2011-57386 and Japanese Patent Application Laid-Open No. 2009-202967 discuss configurations in which the sheet surface detection mechanism is arranged in a position downstream of the feed roller.

Japanese Patent No. 4612893 discusses a configuration in which a lifter mechanism for lifting up the stacking plate is mechanically operated based on the height of the topmost surface of the sheets on the stacking plate.

However, Japanese Patent Application Laid-Open No. 2011-57386 and Japanese Patent Application Laid-Open No. 2009-202967 do not discuss a sheet surface detection position in a width direction orthogonal to a feeding direction. Consequently, with the configurations discussed in Japanese Patent Application Laid-Open No. 2011-57386 and Japanese Patent Application Laid-Open No. 2009-202967, it is sometimes been not possible to appropriately detect the sheet surface if the sheets stacked on the stacking plate are curled (wavy) in the width direction. Appropriately controlling the height of the topmost surface of the sheets on the stacking plate is also important in a configuration that mechanically controls the lifter mechanism, like the configuration discussed in Japanese Patent No. 4612893.

SUMMARY OF THE INVENTION

The present invention is directed to a feeding apparatus and an image forming apparatus capable of appropriately controlling the height (position) of the topmost surface of the sheets stacked on the stacking plate.

According to an aspect of the present invention, a feeding apparatus for feeding a sheet includes a stacking member configured to stack a sheet, a vertically movable feed roller configured to feed the sheet stacked on the stacking member, a vertically movable contact member including a sheet contact portion configured to make contact with the sheet stacked on the stacking member, and a lifting unit configured to lift up the stacking member, the lifting unit being configured to stop lifting up of the stacking member as the sheet contact portion is pressed to lift up by the sheet stacked on the stacking member. The feed roller is pressed to move upward by the sheet stacked on the stacking member while the lifting unit lifts up the stacking member. At least a part of the sheet contact portion is arranged downstream of a position where the feed roller makes contact with the sheet in a feeding direction of the sheet by the feed roller, and inside an area where the feed roller makes contact with the sheet in an axial direction of the feed roller.

Further features of the present invention will become apparent from the following description of exemplary embodiments with reference to the attached drawings.

DESCRIPTION OF THE EMBODIMENTS

Basic Configuration of Image Forming Apparatus

Figure 1:
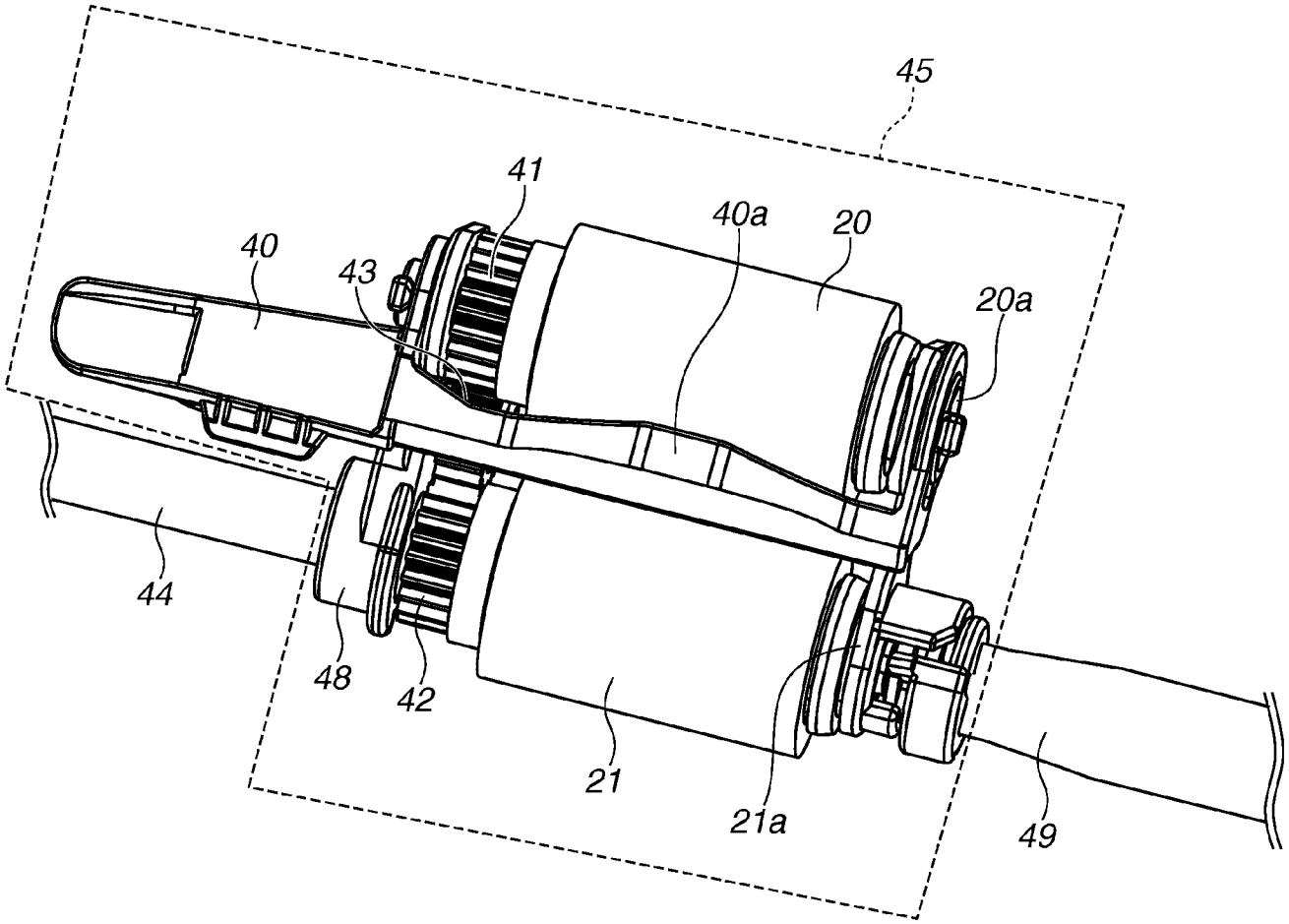
FIG. 1 is a diagram illustrating a configuration of a first exemplary embodiment.

A first exemplary embodiment to which an exemplary embodiment of the present invention is applied will be described below with reference to the drawings. Common elements in the drawings will be designated by the same reference numerals.

Figure 10:
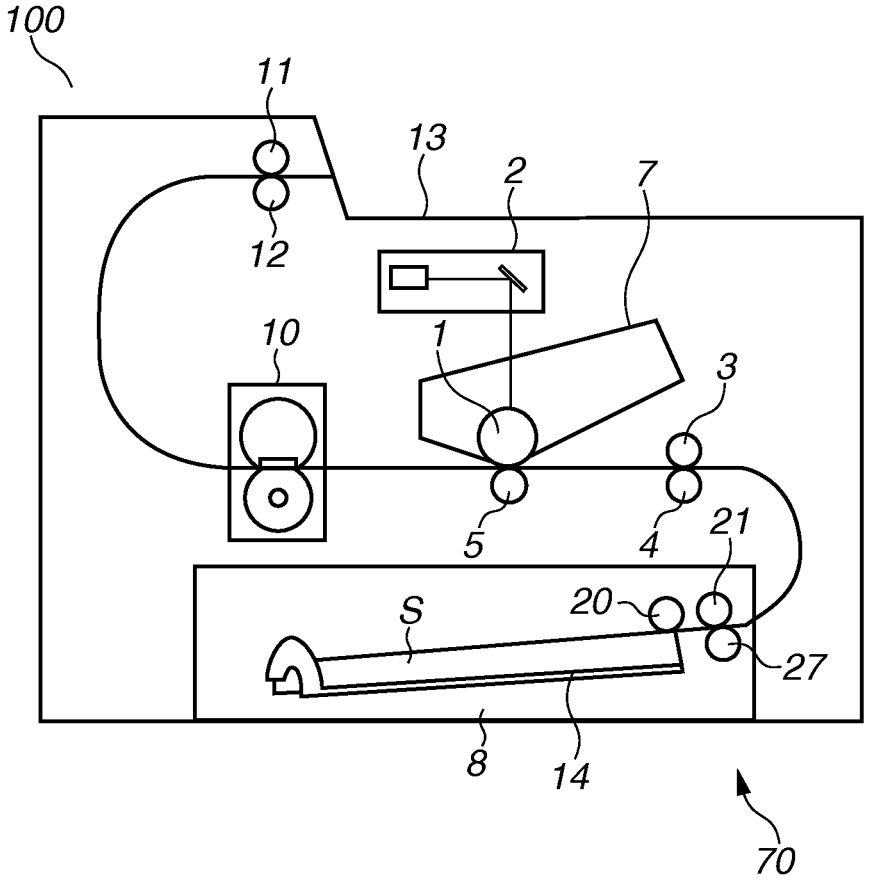
FIG. 10 is a diagram illustrating an entire image forming apparatus according to an exemplary embodiment of the present invention.

FIG. 10 is a sectional view illustrating an outline of a printer which is an example of an image forming apparatus including a feeding apparatus according to the first exemplary embodiment. The present exemplary embodiment deals with an electrophotographic image forming apparatus which forms a toner image.

An image forming apparatus 100 includes a cartridge 7 in which a photosensitive drum 1 serving as an image bearing member is included. An exposure unit 2 which emits laser based on image information to form an image on the photosensitive drum 1 is arranged near the photosensitive drum 1. A transfer roller 5 is provided which transfers a toner image on the photosensitive drum 1 to a sheet. The transfer roller 5 and the photosensitive drum 1 constitute a transfer unit for transferring the toner image to a sheet S.

Sheets S stacked on a sheet stacker (stacking member) 14 arranged in a feed cassette 8 are fed by a feed roller 20. A fed sheet S passes a contact portion between a conveyance roller 21 and a separation roller (separation member) 27 which is arranged in a position opposed to the conveyance roller 21. The sheet S is conveyed by a registration roller pair 3 and 4 to the transfer unit in time with the toner image. The transfer unit transfers the toner image to a surface of the sheet S. A fixing unit 10 fixes the toner image on the sheet S. The sheet S is then discharged by a discharge roller pair 11 and 12 to a discharge tray 13.

In the present exemplary embodiment, an electrophotographic image formation process using the transfer unit and the fixing unit 10 is employed for an image forming unit for forming an image on the sheet S. However, the present invention should not be limited thereto. For example, in an exemplary embodiment of the present invention, the image forming unit for forming an image on the sheet S may use an inkjet image formation process in which liquid ink is discharged from a nozzle to form an image on a sheet.

Figure 11:
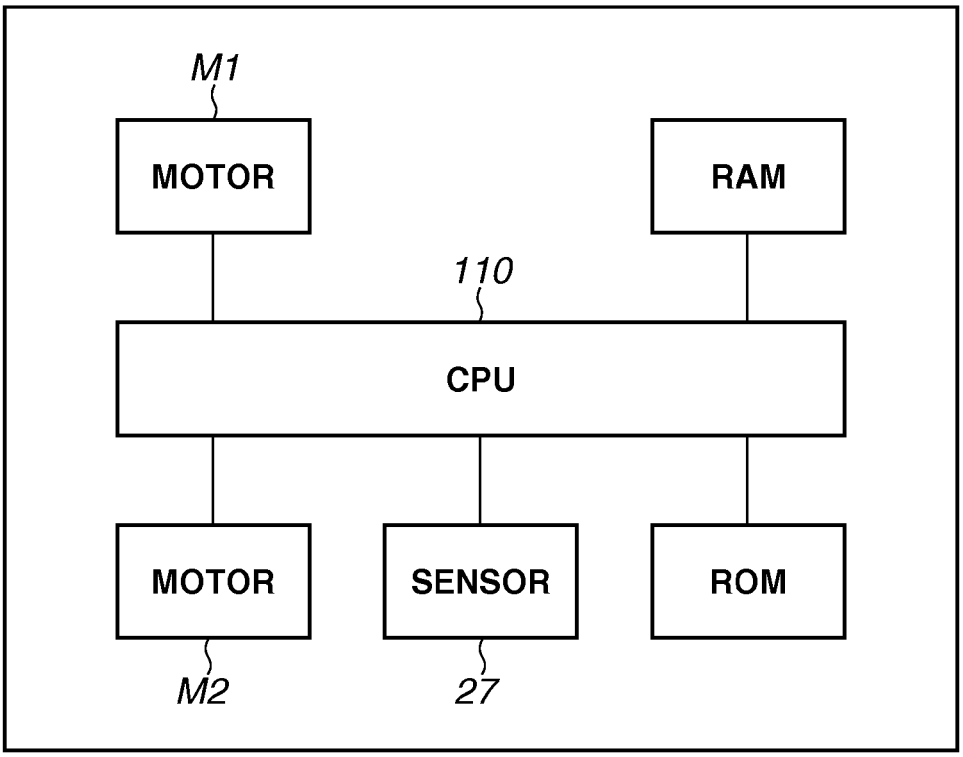
FIG. 11 is a block diagram of an exemplary embodiment of the present invention.

FIG. 11 is a block diagram of the first exemplary embodiment. As illustrated in FIG. 11, a central processing unit (CPU) 110 is connected with a motor M1, a motor M2, and a sensor 27 to be described below. The CPU 110 is also connected with a read-only memory (ROM) and a random access memory (RAM). Using the RAM as a work memory, the CPU 110 executes a program stored in the ROM. In the first exemplary embodiment, the CPU 110, the ROM, and the RAM constitute a control unit.

<Basic Configuration and Operation of Feeding Apparatus 70>

Figure 2:
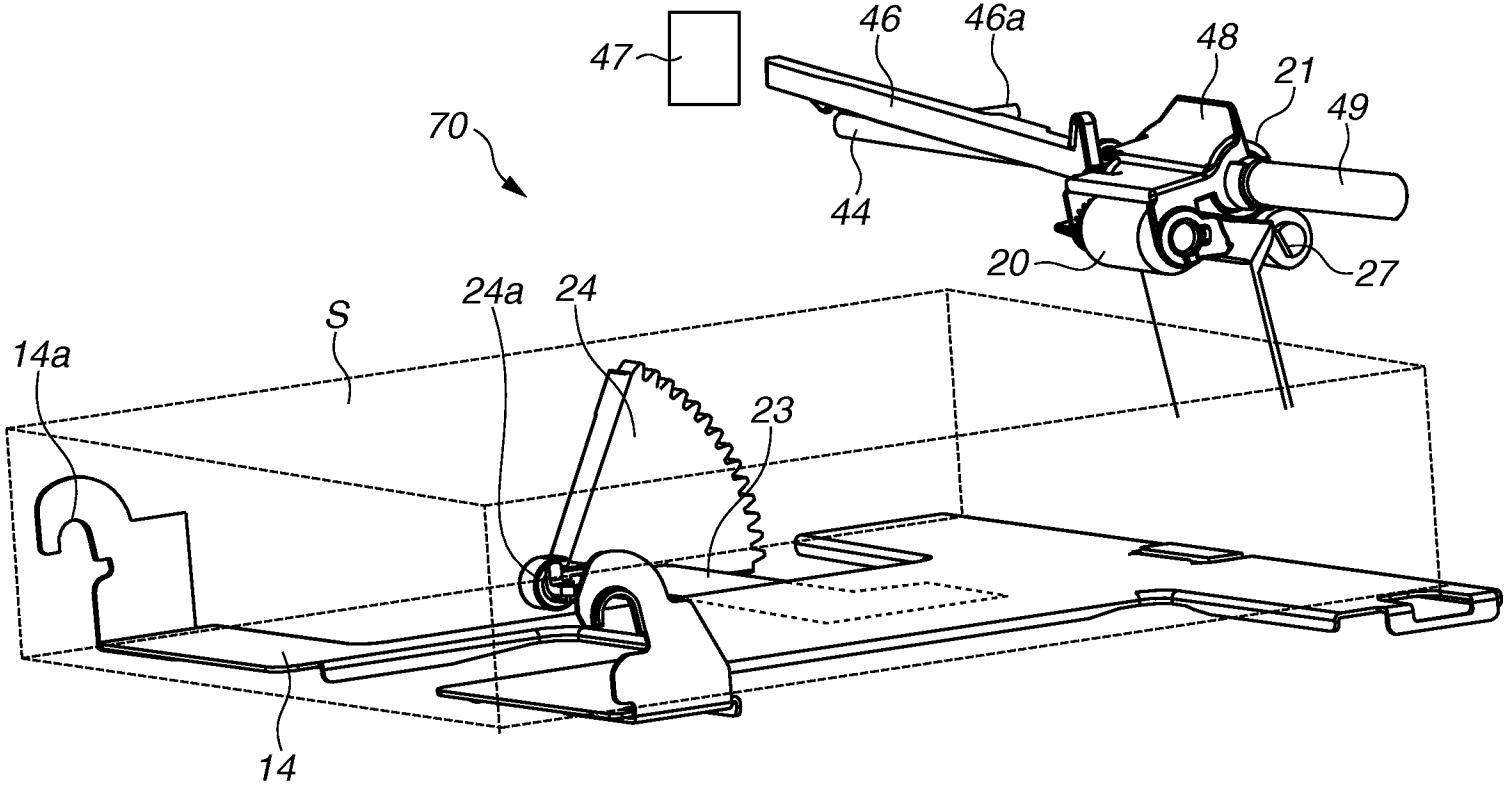
FIG. 2 is a diagram illustrating a configuration of the first exemplary embodiment.

Next, a basic configuration and operation of a feeding apparatus 70 according to the first exemplary embodiment will be described. FIG. 1 is a view of a feed roller unit 45 according to the first exemplary embodiment as seen from below. FIG. 2 is a perspective view illustrating an overall configuration of the feeding apparatus 70.

Figure 8:
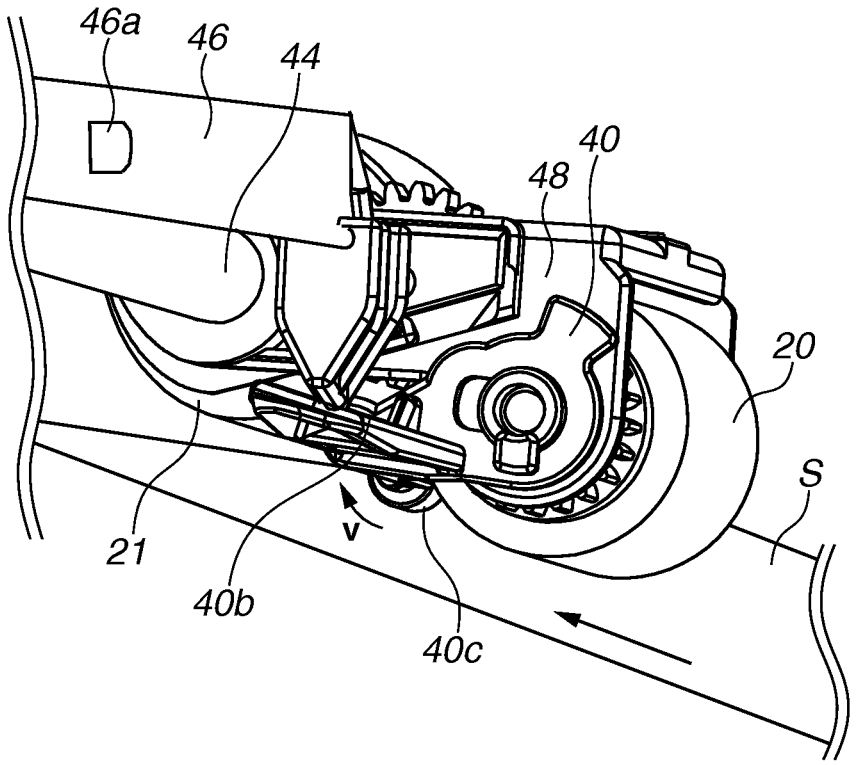
FIG. 8 is a diagram illustrating a configuration of the second exemplary embodiment.
Figure 9:
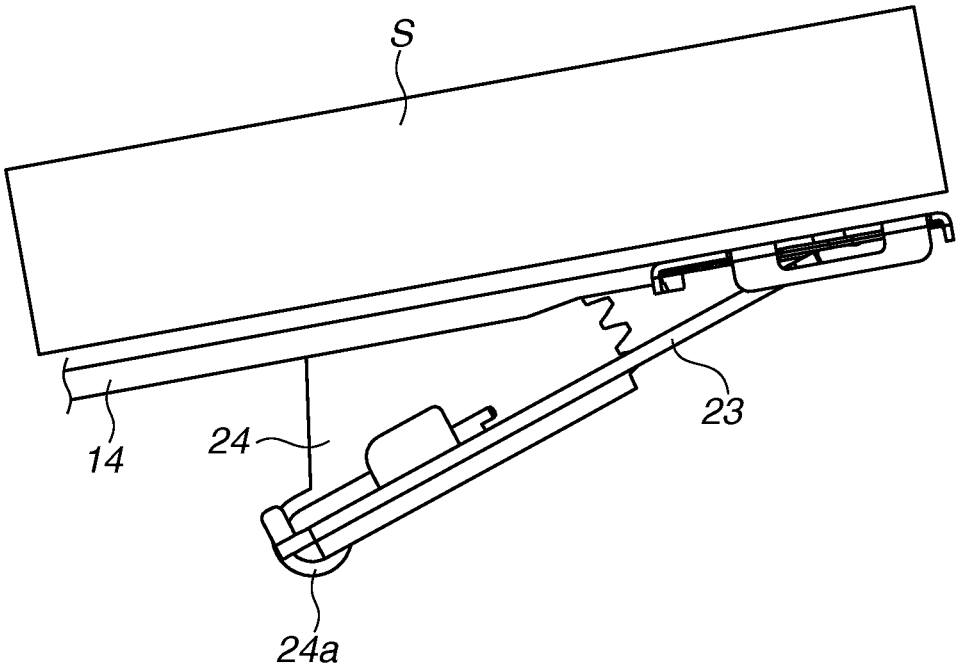
FIG. 9 is a diagram illustrating a configuration of the first exemplary embodiment.

The feeding apparatus 70 illustrated in FIG. 2 can convey the sheets S stacked on the sheet stacker 14 to a downstream side of the conveyance roller 21. The sheet stacker 14 is arranged inside the feed cassette 8. The sheet stacker 14 is supported to be rotatable about hook portions 14*a* by not-illustrated shafts arranged on the feed cassette 8 (FIG. 8). A lifter plate 23 is integrally configured with a sector gear 24. The lifter plate 23 rotates about a rotation center 24*a* along with the sector gear 24. As illustrated in FIG. 9, a part of the lifter plate 23 makes contact with the sheet stacker 14. With such a configuration, the orientation of the sheet stacker 14 is determined by the position of the lifter plate 23. More specifically, if the lifter plate 23 rotates upward, the sheet stacker 14 rotates so that its downstream side in the feeding direction lifts up. In the first exemplary embodiment, the motor M2 (FIG. 11), the sector gear 24, and the lifter plate 23 constitute a lifting unit that lifts up the sheet stacker 14.

The feed roller 20 and the conveyance roller 21 are held by a roller holder (holding member) 48. The feed roller 20 and the conveyance roller 21 are arranged on a center side of the sheets S stacked on the stacking member 14 in an axial direction of the feed roller 20. The roller holder 48 is configured to be swingable about a conveyance roller fulcrum 21*a* relative to a not-illustrated feeding frame. A conveyance gear 42 is arranged coaxially with the conveyance roller 21. A feed gear 41 is arranged coaxially with the feed roller 20. An idler gear 43 is interposed between the conveyance gear 42 and the feed gear 41.

A coupling shaft 44 for transmitting the driving force of the motor M1 to the conveyance gear 42 is arranged on the not-illustrated feeding frame. With such a configuration, the driving force generated by the motor M1 is transmitted to the feed roller 20 and the conveyance roller 21.

The feeding apparatus 70 includes the motor (driving source) M1 which generates the driving force for rotating the conveyance roller 21 and the feed roller 20. The driving force of the motor M1 rotates the coupling shaft 44, whereby the conveyance gear 42 coupled with the coupling shaft 44 is rotated.

Figure 4A:
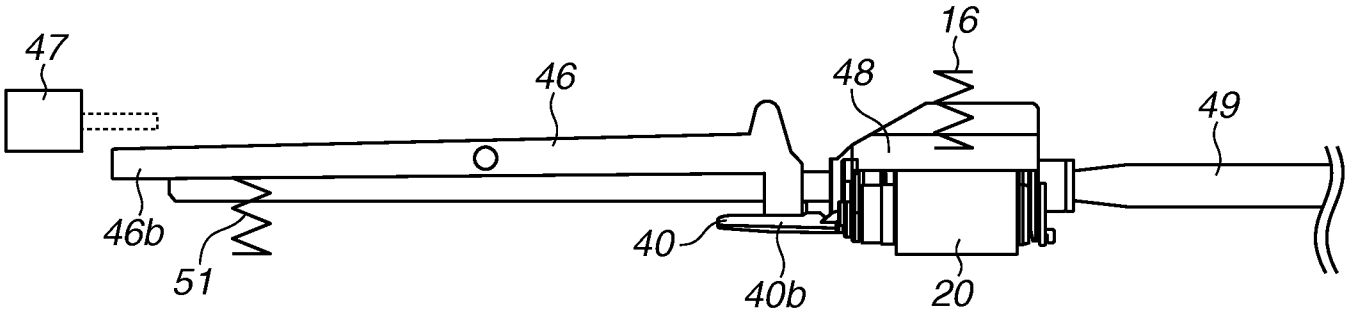
FIGS. 4A and 4B are diagrams illustrating a configuration of the first exemplary embodiment.
Figure 4B:
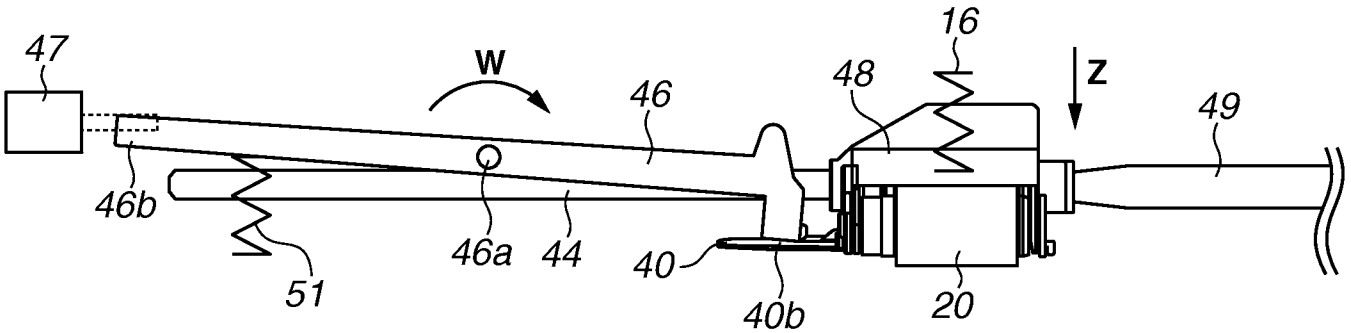

As illustrated in FIGS. 4A and 4B, a feed pressure spring 16 is attached to the roller holder 48. The feed pressure spring 16 applies a constant feed roller pressure to the sheets S on the sheet stacker 14. While the lifting unit is lifting up the sheet stacker 14, the roller holder 48 is pressed by the sheets S stacked on the sheet stacker 14 to move upward against the elastic force of the feed pressure spring 16.

<Detailed Configuration and Operation of Feed Roller Unit 45>

Next, a configuration and operation of the feed roller unit 45 will be described with reference to FIGS. 1 to 4B. In the present exemplary embodiment, the feed roller unit 45 refers to a unit that includes the feed roller 20, the feed gear 41, the conveyance roller 21, the conveyance gear 42, the idler gear 43, the roller holder 48, and a first lever 40.

The feeding apparatus 70 includes a sheet detection unit that detects the sheets S stacked on the sheet stacker 14. The sheet detection unit includes the first lever 40 (contact member) and a second lever (moving member) 46. The first lever 40 is configured to be vertically movable, and moves up when pressed by the sheets S stacked on the sheet stacker 14. The second lever 46 rotates in contact with the first lever 40. A sensor 47 detects the rotation of the second lever 46, so that the sheet detection unit can detect the amount (height) of sheets S stacked on the sheet stacker 14. As illustrated in FIGS. 2, 4A, and 4B, to turn ON/OFF the sensor 47 by the vertical movement of the first lever 40 which is arranged in the center portion in the axial direction of the feed roller 20, the second lever 46 includes a flag portion 46*b* (an extension portion) extending in the axial direction of the feed roller 20.

Figure 3:
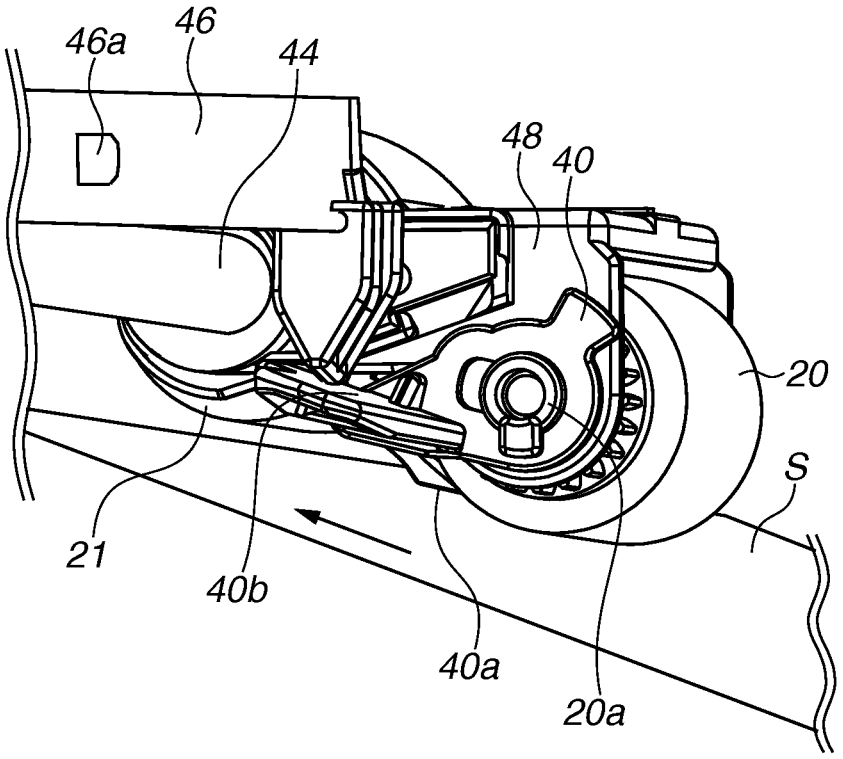
FIG. 3 is a diagram illustrating a configuration of the first exemplary embodiment.

As illustrated in FIG. 1, the first lever 40 is swingably held by the roller holder 48, coaxially with respect to a rotation shaft 20*a* of the feed roller 20. The sheets S on the sheet stacker 14 make contact with a sheet contact portion 40*a* of the first lever 40. The sheet contact portion 40*a* is arranged in the center portion in the axial direction of the feed roller 20. More specifically, in the axial direction of the feed roller 20, the sheet contact portion 40*a* is arranged inside and within an area where the feed roller 20 makes contact with a sheet S. The reason is to appropriately determine the position of the feed roller 20, even if the sheet S is curled. In the feeding direction, the sheet contact portion 40*a* is arranged on the downstream side from the position where the feed roller 20 makes contact with the sheet S and the upstream side from the position where the conveyance roller 21 makes contact with the sheet S. The reason is to minimize a change in the position where the sheet S enters the conveyance roller 21 even if the angle of the topmost surface of the sheets S changes with the amount of sheets S stacked on the sheet stacker 14. As illustrated in FIG. 3, if the sheet stacker 14 is lifted up by the driving force of the motor M2, a protrusion of the sheet contact portion 40*a* of the first lever 40 makes contact with the topmost surface of the sheets S on the sheet stacker 14 and the first lever 40 moves up. Then, a lever contact portion 40*b* of the first lever 40 comes into contact with the second lever 46 which is rotatably held with a rotation center 46*a* as the fulcrum.

If sheets S are set on the sheet stacker 14, the sector gear 24 and the lifter plate 23 operating integrally with the sector gear 24 are rotated in a counterclockwise direction in FIG. 2 by the driving force of the motor M2. The sheet stacker 14 is configured to operate integrally with the lifter plate 23, and rotates about the rotation center 24*a*. As illustrated in FIG. 9, a part of the lifter plate 23 makes contact with the back side of the sheet stacker 14. With such a configuration, the orientation (position) of the sheet stacker 14 is determined by the position of the lifter plate 23.

As illustrated in FIGS. 4A and 4B, the optical sensor 47 is arranged near a flag portion 46*b* of the second lever 46. The flag portion 46*b* is configured to move between a first position (FIG. 4A) where light of the sensor 47 is transmitted and a second position (FIG. 4B) where the light is blocked.

At the point when the sheets S are set on the sheet stacker 14 (the sheet stacker 14 is not lifted up), the flag portion 46*b* of the second lever 46 is biased upward by a second lever spring 51 to be in the second position where the light of the sensor 47 is blocked. The CPU 110 then drives the motor M2 to rotate the sheet stacker 14 upward as the sheet stacker 14 is loaded into the main body of the feeding apparatus 70.

Next, the topmost surface of the sheets S comes into contact with the feed roller 20 and the sheet contact portion 40*a* of the first lever 40. The feed roller 20 and the first lever 40 are pushed up by the sheets S. The lever contact portion 40*b* of the first lever 40 makes contact with the second lever 46, so that the second lever 46 rotates about the rotation center 46*a*, and the flag portion 46*b* rotates as well. If the flag portion 46*b* moves to the first position where the light of the sensor 47 is transmitted, the CPU 110 stops driving the motor M2. This completes the lift-up of the sheet stacker 14, and the sheets S on the sheet stacker 14 come to a position where the feed roller 20 is able to feed the sheets S.

In the foregoing description, the lift-up operation of the sheet stacker 14 is controlled based on the detection result of the turn ON/OFF of the optical sensor 47 by the second lever 46. However, the present invention should not be limited thereto. For example, like the configurations discussed in Japanese Patent Application Laid-Open No. 2009-12925 and Japanese Patent Application Laid-Open No. 2014-105099, without providing an optical sensor, the lift-up operation of the sheet stacker 14 may be mechanically performed according to the position of the sheets S on the sheet stacker 14. More specifically, for example, the first lever 40 and the second lever 46 which move up and down according to the position of the sheets S on the sheet stacker 14 may be configured to disconnect or connect a drive transmission unit between the motor M2 and the lifter plate 23. If the position of the sheets S on the sheet stacker 14 lowers, the sheet contact portion 40*a* also lowers. In accordance with this motion, the drive transmission unit is mechanically connected to start lifting up the sheet stacker 14. If the lift-up operation is completed and the position of the sheets S on the sheet stacker 14 is lifted up, the sheet contact portion 40*a* is also lifted up. In accordance with this motion, the drive transmission unit is disconnected to stop lifting up the sheet stacker 14.

Figure 12:
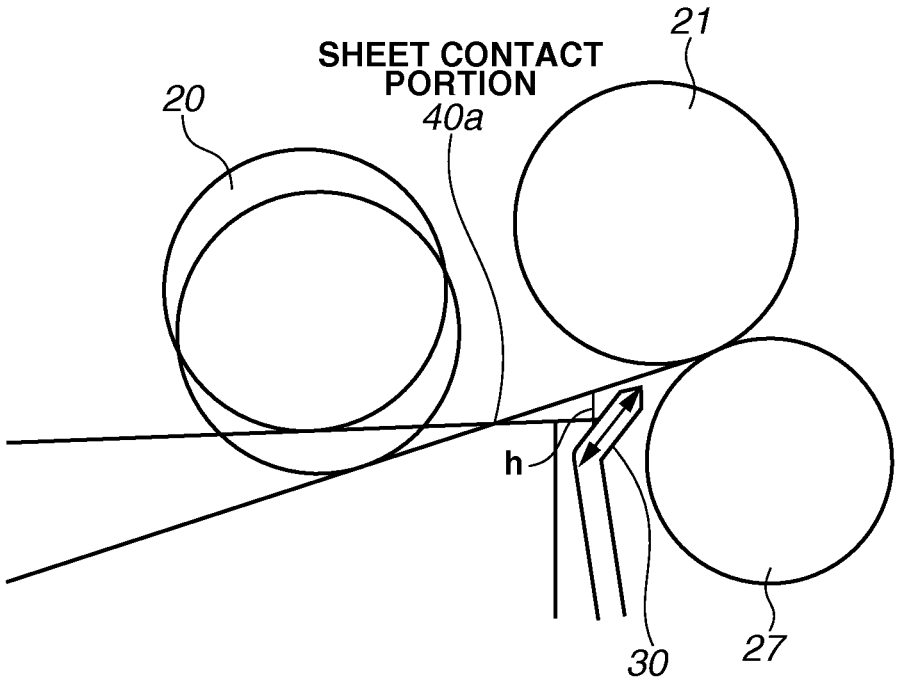
FIG. 12 is a diagram illustrating a configuration of the first exemplary embodiment.

As illustrated in FIG. 12, in the present exemplary embodiment, the roller holder 48 is pressed by the sheets S stacked on the sheet stacker 14 to move upward against the elastic force of the feed pressure spring 16 while the lifting unit is lifting up the sheet stacker 14. The lift-up operation of the sheet stacker 14 is stopped as the sheet contact portion 40*a* is pressed by the sheets S stacked on the sheet stacker 14 (as the sheets S on the sheet stacker 14 reach a predetermined position). The position of the feed roller 20 having stopped lift-up when the amount of sheets S stacked on the sheet stacker 14 is a first amount, is lower than the feed roller 20 having stopped lift-up when the amount of sheets S stacked on the sheet stacker 14 is a second amount. The second amount is greater than the first amount. In other words, the amount of upward movement of the roller holder 48 when the amount of sheets S stacked on the sheet stacker 14 is the first amount, is smaller than the amount of upward movement of the roller holder 48 when the amount of sheets S stacked on the sheet stacker 14 is the second amount which is greater than the first amount. As described above, according to the present exemplary embodiment, the feed roller 20 is vertically movable and the sheet contact portion 40*a* is located on the downstream side from the position where the feed roller 20 makes contact with the sheets S. Accordingly, even if the amount of sheets S stacked on the sheet stacker 14 changes, a change in the angle (change in the height h) at which the sheet S fed by the feed roller 20 enters the separation nip portion between the conveyance roller 21 and the separation roller 27 can thus be reduced. Further, a nip guide 30 for guiding the fed sheet S into the separation nip portion is provided on the upstream side from the separation nip portion.

Next, an operation for feeding the sheets S will be described.

The CPU 110 drives the motor M1 to rotate the conveyance roller 21 and the feed roller 20 based on a feed start signal from a computer or the image forming apparatus 100. Sheets S fed by the feed roller 20 are separated one by one by the conveyance roller 21 and the separation roller 27, and fed to the registration roller pair 3 and 4.

As illustrated in FIGS. 4A and 4B, as the sheets S are fed to the image forming unit and the number of sheets S on the sheet stacker 14 decreases, the feed roller 20 and the first lever 40 move gradually in a Z direction (downward) in the diagrams. In other words, the flag portion 46*b* of the second lever 46 rotates in a W direction in FIG. 4B, and the position of the flag portion 46*b* approaches the second position from the first position.

If a certain number of sheets S are fed and the position of the flag portion 46*b* of the second lever 46 reaches the second position, the CPU 110 drives the motor M2 to rotate the sheet stacker 14 until the position of the flag portion 46*b* reaches the first position. The feeding apparatus 70 repeats the foregoing operation during the feeding operation of the sheets S, so that the height of the sheets S on the sheet stacker 14 is controlled to be within a predetermined range.

As the feeding of the sheets S is repeated in the foregoing feeding operation, the feed roller 20 wears off gradually. The sheet contact portion 40*a* of the first lever 40 also wears off together. In the present exemplary embodiment, the sheet contact portion 40*a* is configured to have a width narrower than that of the feed roller 20 so that the positional relationship between the sheet contact portion 40*a* and the feed roller 20 will not change along with the progress of wear.

Next, a configuration for attaching and detaching the feed roller unit 45 according to the present exemplary embodiment to/from the image forming apparatus 100 will be described with reference to FIGS. 5, 6A, and 6B.

Figure 5:
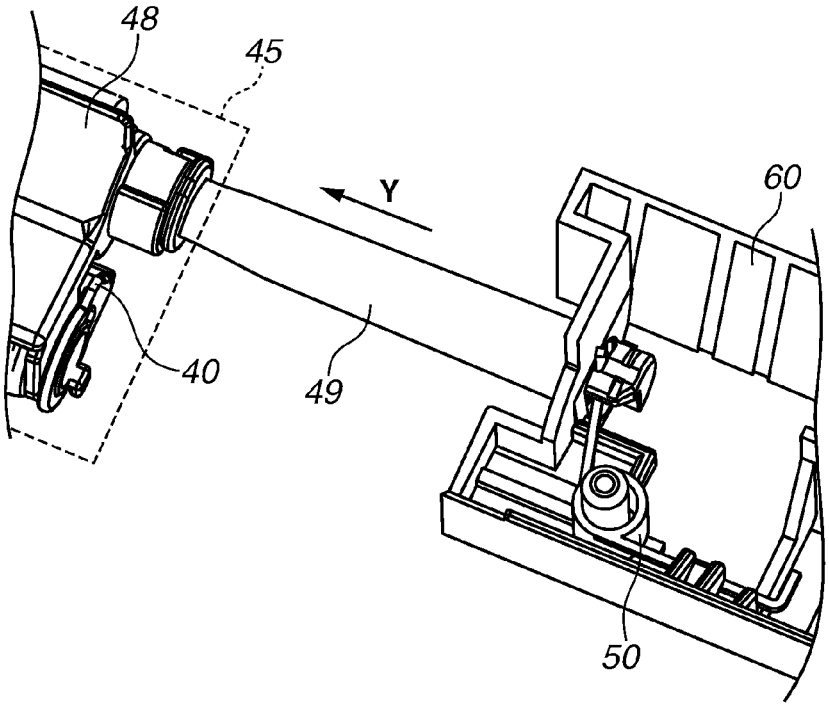
FIG. 5 is a diagram illustrating an operation of the first exemplary embodiment.

As illustrated in FIG. 5, the feed roller unit 45 is held by a slide shaft (connection member) 49. The slide shaft 49 is biased in the direction of the arrow Y, i.e., in a direction orthogonal to the feeding direction of the sheets S (in the axial direction of the feed roller 20) by a slide shaft spring (biasing member) 50 which is attached to the feeding frame 60. The spring pressure (biasing force) of the slide shaft spring 50 is set so that the feed roller unit 45 will not come off in an unintended situation (when feeding the sheets S or during jam handling).

Figure 6A:
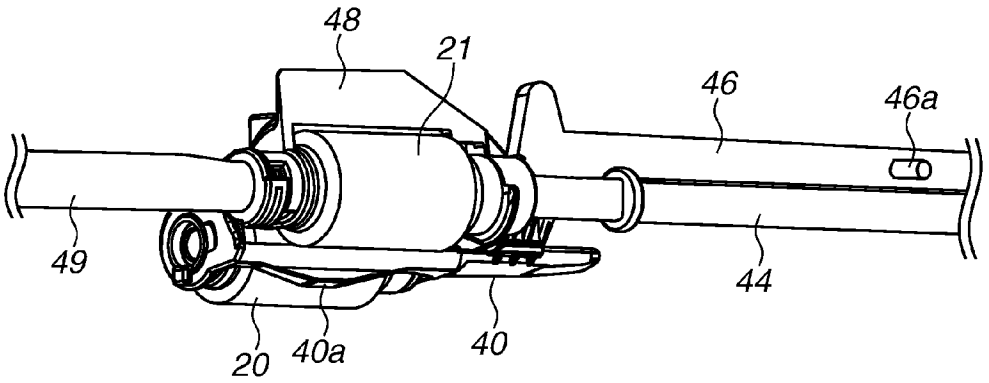
FIGS. 6A and 6B are diagrams illustrating the operation of the first exemplary embodiment.
Figure 6B:
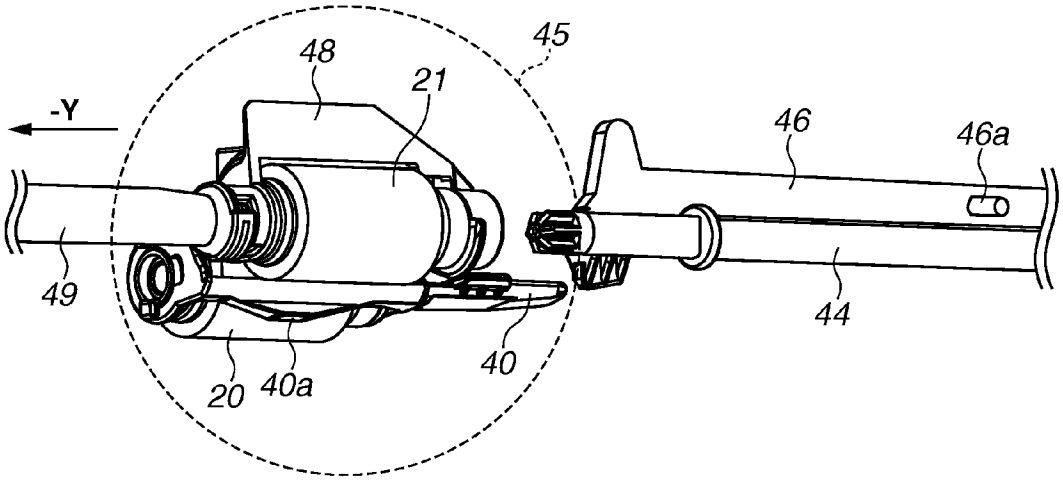

As illustrated in FIGS. 6A and 6B, when detaching the feed roller unit 45 from the image forming apparatus 100, the user grips the roller holder 48 in the state of FIG. 6A. The user then slides the slide shaft 49 in a −Y direction as illustrated in FIG. 6B. The user can thereby move the feed roller unit 45 in the −Y direction to separate the feed roller unit 45 from the coupling shaft 44 arranged on the main body of the image forming apparatus 100, and detach the feed roller unit 45 from the image forming apparatus 100. As described above, the feed roller 20 and the first lever 40 are integrated as the feed roller unit 45. The feed roller 20 and the first lever 40 can thus be simultaneously detached from the image forming apparatus 100. In other words, the roller holder 48 can be detached from the image forming apparatus (apparatus main body) 100 while holding the feed roller 20 and the first lever 40.

When attaching a new feed roller unit 45 to the image forming apparatus 100, the user can put the feed roller unit 45 on the slide shaft 49 and slide the slide shaft 49 in the Y direction to engage the feed roller unit 45 with the coupling shaft 44.

As described above, the present exemplary embodiment includes the first lever 40 which lifts up in contact with the sheets S and the second lever 46 which lifts up in contact with the first lever 40, as the mechanism for appropriately adjusting the sheet surface (height) of the sheets S stacked on the sheet stacker 14. The roller holder 48 holds the first lever 40. In such a manner, the sheet contact portion 40*a* of the first lever 40 can be located, in the feeding direction, between the position where the feed roller 20 makes contact with a sheet S and the position where the conveyance roller 21 makes contact with the sheet S without increasing the size of the image forming apparatus 100. The sheet contact portion 40 can also be located within the area of the feed roller 20 in the axial direction of the feed roller 20. In other words, the area where the feed roller 20 makes contact with the sheet S and the area where the sheet contact portion 40*a* makes contact with the sheet S overlap in the axial direction of the feed roller 20.

As described above, according to the present exemplary embodiment, the feed roller 20 and the first lever 40 can be simultaneously replaced. The positional relationship between the portion where the feed roller 20 makes contact with the sheet S and the sheet contact portion 40*a* of the first lever 40 can thus be maintained identical before and after the replacement of the roller unit 48.

Consequently, according to the present exemplary embodiment, the orientation (position) of the leading edge of the sheet S fed out by the feed roller 20 can be maintained substantially constant. This can suppress variations of the sheet feeding performance. Further, the present exemplary embodiment also has high usability and serviceability because the individual components (the feed roller 20 and the first lever 40) do not need to be separately replaced or subjected to maintenance.

Next, a second exemplary embodiment to which an exemplary embodiment of the present invention is applied will be described. In the following description of the second exemplary embodiment, a description of configurations and operations common to the first exemplary embodiment will be omitted.

<Basic Configuration and Operation>

A basic configuration and a basic operation of the second exemplary embodiment are similar to those of the first exemplary embodiment. A description thereof is thus omitted.

<Detailed Configuration and Operation>

A characteristic configuration of the second exemplary embodiment will be described with reference to FIGS. 7 and 8.

Figure 7:
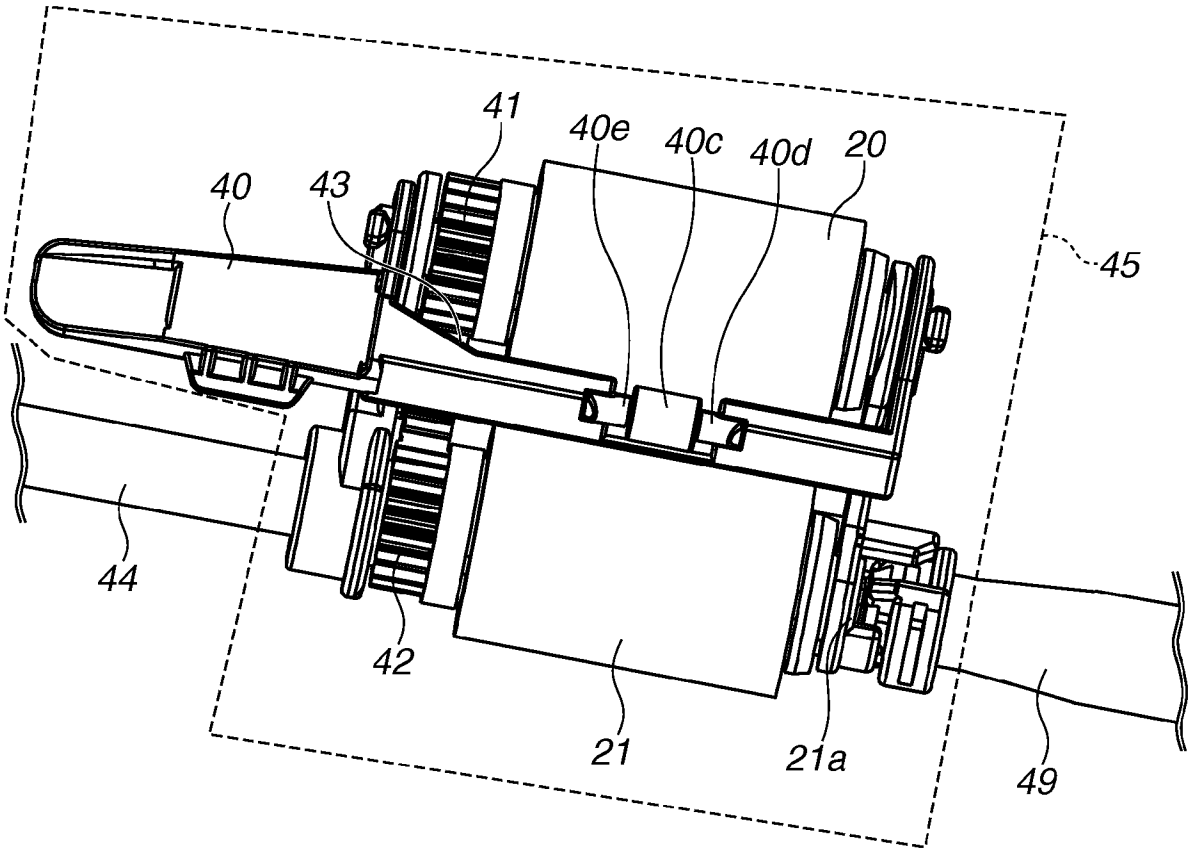
FIG. 7 is a diagram illustrating a configuration of a second exemplary embodiment.

FIG. 7 is a diagram illustrating a configuration of the second exemplary embodiment. In the second exemplary embodiment, the first lever 40 includes a roller (driven rotation member) 40*c*. The roller 40*c* is rotatably supported at both ends by roller shaft portions 40*d* and 40*e* inserted into holes in the first lever 40. In the second exemplary embodiment, the sheets S on the sheet stacker 14 make contact with the roller 40*c*.

FIG. 8 illustrates an operation of the second exemplary embodiment. When a sheet S is fed by the feed roller 20, the roller 40*c* is driven by the sheet S to smoothly rotate in a V direction in the diagram. According to the second exemplary embodiment, the conveyance resistance of the sheet S during the feeding of the sheet S can thus be reduced. In other words, damage to the sheet S and the driving torque for sheet feeding can be reduced.

The configuration for attaching and detaching the feed roller unit 45 is similar to that of the first exemplary embodiment. More specifically, in the second exemplary embodiment, the feed roller 20, the first lever 40, and the roller 40*c* integral with the first lever 40 are integrated as the feed roller unit 45. The feed roller 20, the first lever 40, and the roller 40*c* can thus be simultaneously detached from the image forming apparatus 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-054175 filed Mar. 17, 2014, which is hereby incorporated by reference herein in its entirety.

What is claimed is:

1. A feeding apparatus for feeding a sheet, the feeding apparatus comprising:

a stacking member configured to stack a sheet;

a feed roller configured to feed the sheet stacked on the stacking member, wherein the feed roller is movable in a vertical direction;

a contact member including a sheet contact portion configured to make contact with the sheet stacked on the stacking member, wherein the contact member is movable in a vertical direction; and a lifting unit configured to lift up the stacking member, wherein the lifting unit is configured to stop lifting up of the stacking member as the sheet contact portion is pressed to lift up by the sheet stacked on the stacking member, wherein the feed roller is pressed to move upward by the sheet stacked on the stacking member while the lifting unit lifts up the stacking member, and wherein at least a part of the sheet contact portion is arranged downstream of the feed roller in a feeding direction of the sheet by the feed roller, and between one end and the other end of the feed roller in a width direction intersecting with the feeding direction of the sheet by the feed roller.

2. The feeding apparatus according to claim 1, further comprising a conveyance roller configured to convey the sheet, wherein the conveyance roller is arranged downstream of the feed roller in the feeding direction of the sheet, wherein the sheet contact portion is arranged upstream of a position where the conveyance roller makes contact with the sheet.

3. The feeding apparatus according to claim 1, wherein the contact member is held by a holding member configured to hold the feed roller.

4. The feeding apparatus according to claim 3, further comprising a conveyance roller configured to convey the sheet, wherein the conveyance roller is arranged downstream of the feed roller in the feeding direction of the sheet, and wherein the holding member is configured to hold the feed roller, the conveyance roller, and the contact member.

5. The feeding apparatus according to claim 4, wherein the contact member is held coaxially with a rotation shaft of the feed roller.

6. The feeding apparatus according to claim 1, further comprising a moving member including an extension portion extending in a direction including the width direction of the feed roller, wherein the moving member is configured to move in contact with the contact member, and wherein the lifting unit is configured to stop lifting up of the stacking member according to a position of the extension portion of the moving member.

7. The feeding apparatus according to claim 1, wherein the lifting unit is configured to start lifting up the stacking member as the sheet contact portion lowers.

8. The feeding apparatus according to claim 1, wherein the sheet contact portion includes a protrusion for contact with the sheet conveyed by the conveyance roller.

9. The feeding apparatus according to claim 1, wherein the sheet contact portion includes a driven rotation member to be driven to rotate by the sheet fed by the feed roller.

10. The feeding apparatus according to claim 1, wherein the stacking member is configured to be rotatable, and wherein the lifting unit is configured to rotate the stacking member so that a downstream side of the stacking member in the feeding direction lifts up.

11. The feeding apparatus according to claim 1, wherein, when an amount of sheets stacked on the stacking member is a first amount, a position of the feed roller at which the lifting unit stops lifting up of the stacking member is lower than a position of the feed roller at which the lifting unit stops lifting up of the stacking member when the amount of sheets stacked on the stacking member is a second amount that is greater than the first amount.

12. The feeding apparatus according to claim 1, wherein the feed roller is arranged on a center side of the sheet stacked on the stacking member in the width direction of the feed roller.

13. An image forming apparatus comprising:

the feeding apparatus according to claim 1; and an image forming unit configured to form an image on the sheet fed by the feeding apparatus.

14. The feeding apparatus according to claim 4, further comprising a connection member connected to the holding member, wherein the holding member is detachable from the connection member.

15. The feeding apparatus according to claim 14, wherein the connection member has a slide shaft extending in the width direction, and the slide shaft is movable in the width direction.

16. The feeding apparatus according to claim 1, wherein, to maintain a positional relationship between the at least a part of the sheet contact portion and the feed roller as the feed roller and the at least a part of the sheet contact portion wear, the at least a part of the sheet contact portion has a width that is narrower than a width of the feed roller.

17. The feeding apparatus according to claim 1, wherein the feed roller and the contact member are connected to a feed roller unit such that a feed roller and a contact member of a first feed roller unit can be simultaneously replaced by a second feed roller unit while a positional relationship between a portion where the feed roller makes contact with the sheet and the at least a part of the sheet contact portion of the contact member is maintained identical before and after the replacement of the first feed roller unit.

18. The feeding apparatus according to claim 1, wherein the part of the sheet contact portion is configured to determine a position of the feed roller, even if the sheet is curled.

* * * * *